US005957286A

United States Patent [19]

Ho

[11] Patent Number: 5,957,286

[45] Date of Patent: Sep. 28, 1999

[54] TOOL BOX

[76] Inventor: Chiu-Fu Ho, No. 5, 8-1 Alley, 44 Lane, 1 Sec. Hsin Jen Rd., Tai-Ping Hsiang, Taichung Hsien, Taiwan

[21] Appl. No.: 09/209,689

[22] Filed: Dec. 11, 1998

[51] Int. Cl.[6] ..... B65D 85/28

[52] U.S. Cl. ..... 206/373; 206/378; 220/326

[58] Field of Search ..... 206/373, 379, 206/372, 378; 220/326, 324, 847

[56] References Cited

U.S. PATENT DOCUMENTS

| | | | |
|---|---|---|---|
| 5,353,946 | 10/1994 | Behrend | 220/326 |
| 5,411,163 | 5/1995 | Gueret | 220/326 |
| 5,460,288 | 10/1995 | Balzeau | 220/326 |

*Primary Examiner*—Paul T. Sewell
*Assistant Examiner*—Nhan T. Lam
*Attorney, Agent, or Firm*—Rosenberg, Klein & Bilker

[57] ABSTRACT

A tool box includes an upper frame with a transparent cover mounted thereto and a lower frame with a base member connected to the bottom thereof, a first recess defined in one of the sides of upper frame which is defined by two end walls so that a locking device is movably received in the first recess. The locking device has a flexible plate extending therefrom and a hook extending form the bottom thereof. A second recess is defined in the top surface of the lower frame and a slot defined through the top surface so that the hook is movably engaged with the slot. The flexible plate is urged against to the second end wall when the locking device is shifted to open the cover and will return to its original position by the flexible plate.

3 Claims, 4 Drawing Sheets

TOOL BOX

FIELD OF THE INVENTION

The present invention relates to a tool box, and more particularly, to a tool box having a locking means which is movably received in the recess of the upper frame and has a hook engagable to the lower frame. A flexible plate extending from the locking means so as to provide a return force to let the locking means return to its original position when releasing the locking means.

BACKGROUND OF THE INVENTION

A conventional tool box 1 is shown in FIG. 1 and comprises a cover 2 pivotally connected to a base member 3 and a locking plate 21 extending from a side of the cover 2 so as to engage with a protrusion extending from the base member 3 to securely connect the cover 2 to the base member 3. The locking plate 21 protrudes from the tool box so that it tends to be operated or lifted unintentionally and once the tool box is unintentionally opened, the tools, bits and other parts received in the tool box will drop. Furthermore, the user has to open the tool box to check out what tools are received in the tool box because neither the cover 2 nor the base member 3 is transparent.

The present invention intends to provide a tool box which has a locking means connected to the cover and its outside is flush with the outside of the cover.

The tool box of the present invention provides the tool box equipped with the locking means which mitigates and/or obviate the disadvantages of the conventional tool box.

SUMMARY OF THE INVENTION

In accordance with one aspect of the present invention, there is provided a tool box comprising an upper frame having an L-shaped flange extending laterally from the four sides thereof for a transparent cover securely engaged therewith and a first recess defined in the L-shaped flange. A first end wall and a second end wall are respectively connected between the flange and the upper frame wherein the first recess is located therebetween. A lower frame is pivotally connected to the upper frame and has a base member connected to the bottom thereof. A second recess is defined in the top surface of the lower frame with a slot defined in the top surface.

A locking means is movably received in the first recess and has a hook movably received in the slot of the lower frame. A flexible plate extends from one of two ends of the locking means so that the flexible plate is urged against to the second end wall when the locking means is shifted to open the cover.

The object of the present invention is to provide a tool box which has a locking means connected to the cover and is flush with the outside of the cover.

Another object of the present invention is to provide a locking means for a tool box wherein the locking means automatically returns to its original position when releasing the lock means.

Further features of the present invention will become apparent after a careful reading of the detailed description with appropriate reference to the accompanying drawings.

DETAILED DESCRIPTION OF THE PREFERRED EMBODIMENT

Figure 1:
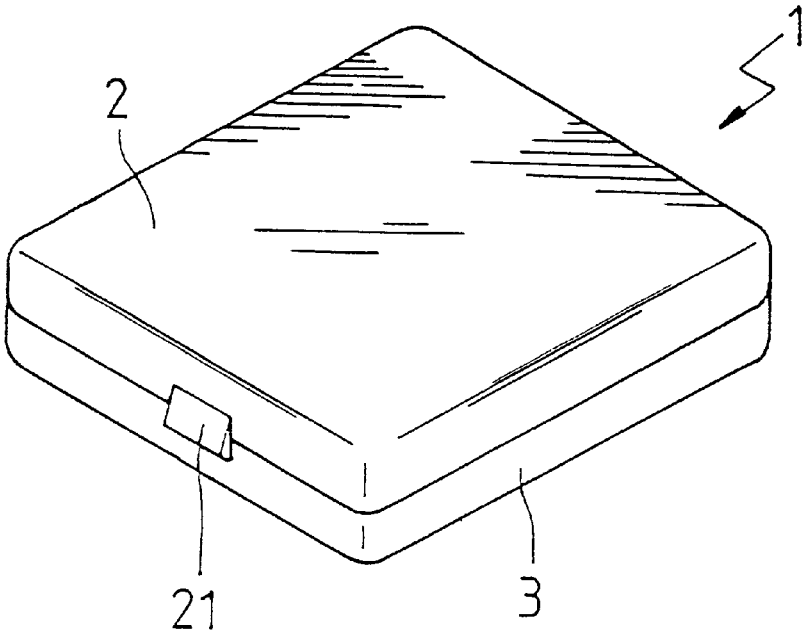
FIG. 1 PRIOR ART
FIG. 1 is a perspective view of a conventional tool box.
Figure 2:
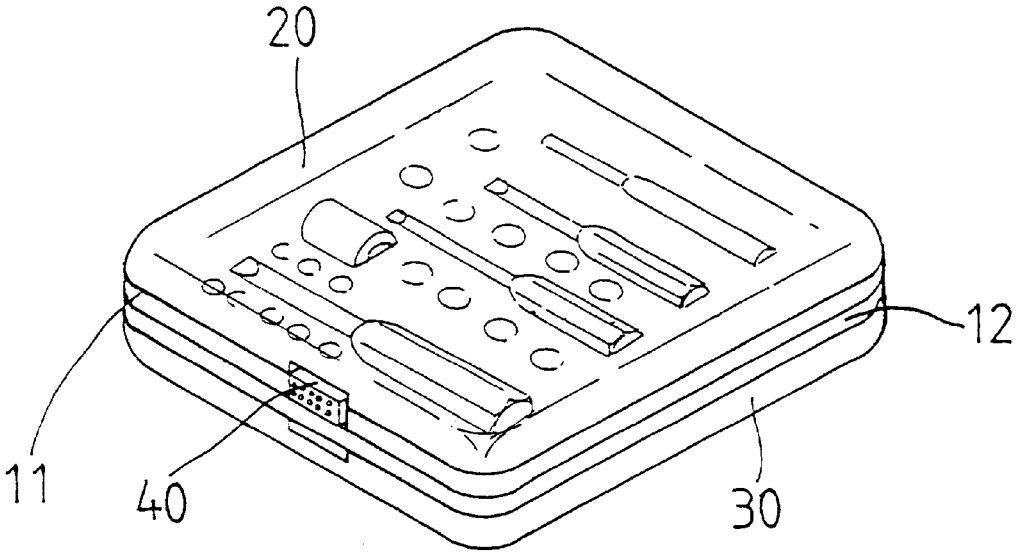
FIG. 2 is a perspective view of the tool box in accordance with the present invention.
Figures 3, 4:
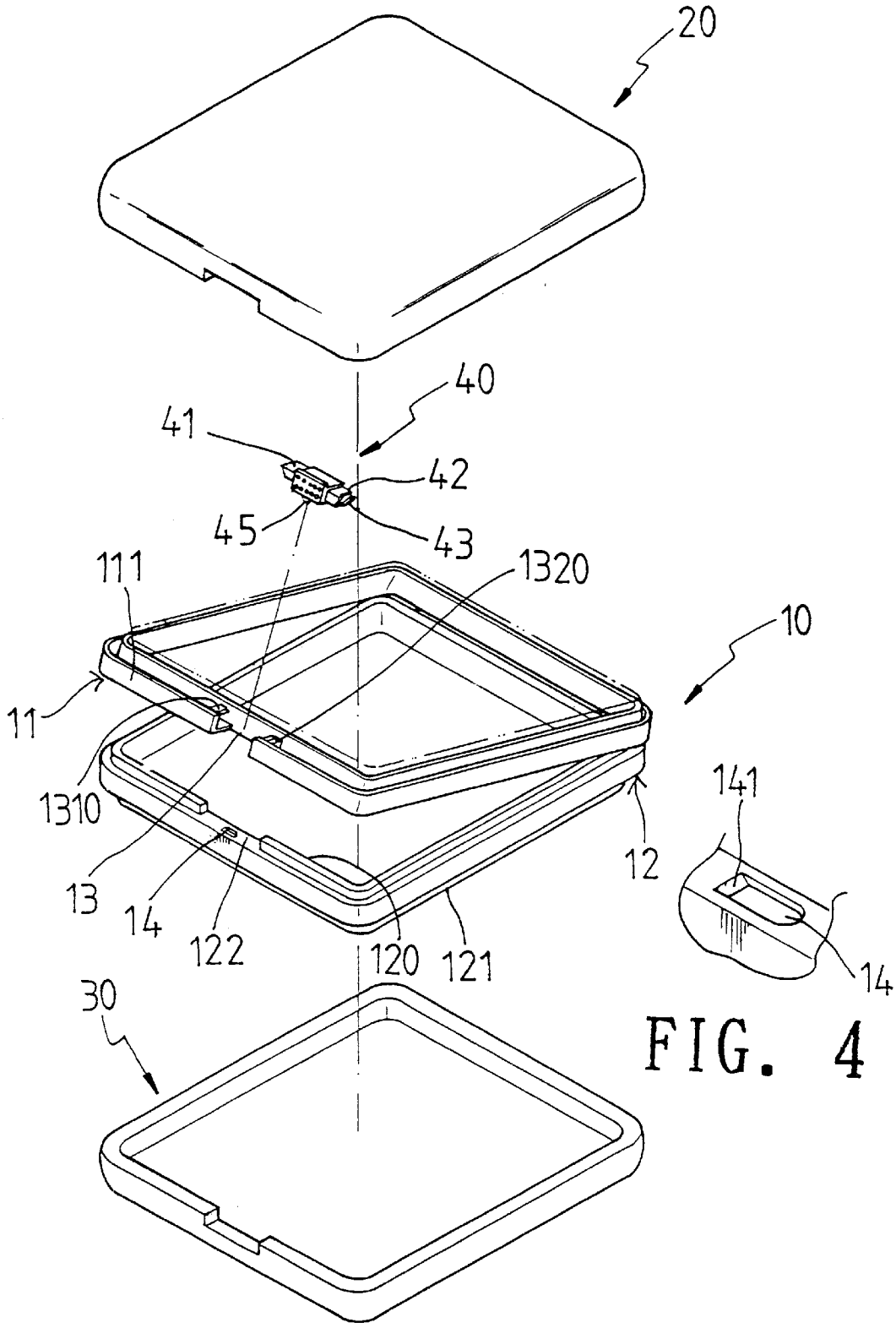
FIG. 3 is an exploded view of the tool box and the locking means in accordance with the present invention.
FIG. 4 is an enlarged view to show the slot defined in the lower frame.
Figure 5:
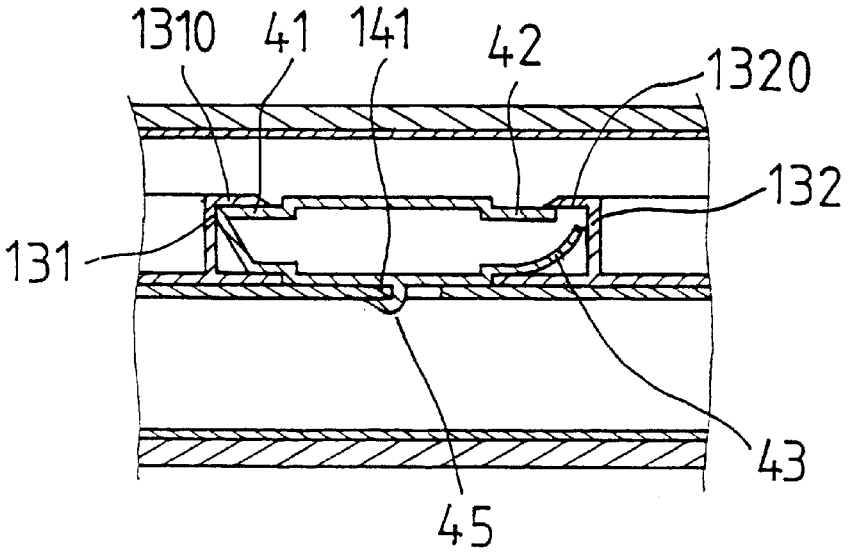
FIG. 5 is a side elevational view, partly in section, of the locking means received in the first recess.

Referring to FIGS. 2 to 5, the tool box in accordance with the present invention comprises an upper frame 11 having an L-shaped flange 111 extending laterally from the four sides thereof and a first recess 13 defined in the L-shaped flange 11. A transparent cover 20 is securely engaged with the L-shaped flange 11. A first end wall 131 and a second end wall 132 are respectively connected between the flange 11 and the upper frame 11. A first upper stop 1310 extends laterally from the top of the first end wall 131 and toward the first recess 13, and a second upper stop 1320 extends laterally from the top of the second end wall 132 and toward the first recess 13. The first recess 13 is defined between the first end wall 131 and the second end wall 132.

A lower frame 12 is pivotally connected to the upper frame 11 and has a base member 30 connected to the bottom thereof. A lip 20 extends form the top surface of the lower frame 12 so as to engage with the upper frame 11. A second recess 122 is defined in the top surface of the lower frame 12, a slot 14 defined in the top surface of the lower frame 12 and located in the bottom defining the second recess 122. One end of the periphery of the slot 14 is an inclined surface 141.

A locking means 40 is movably received in the first recess 13 and its two ends 41, 42 are movably restrained between the first upper stop 1310 and the second upper stop 1320. A hook 45 extends from the bottom of the locking means 40 so as to be movably received in the slot 14 of the lower frame 12, and a flexible plate 43 extends from the bottom of the end 42 of the locking means 40.

Figure 6:
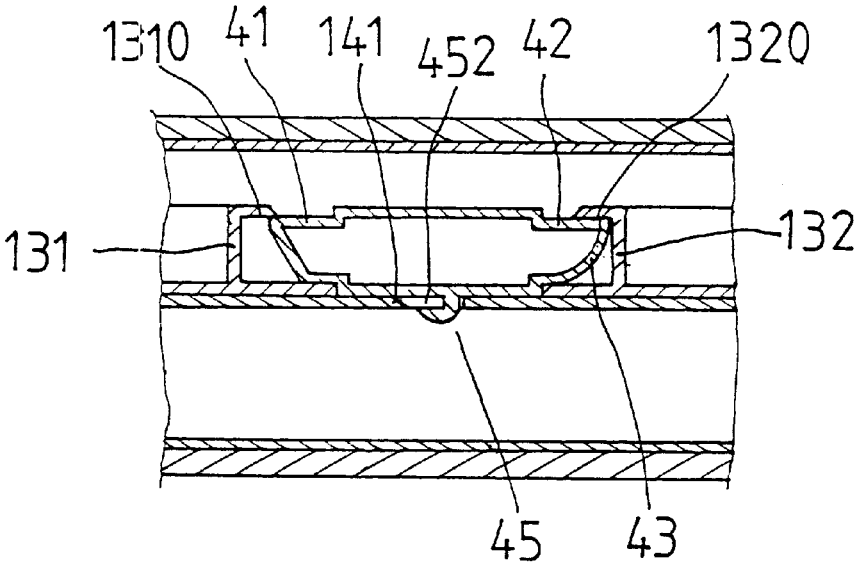
FIG. 6 is a side cross-sectional view to show the locking means is shifted to let the hook of thing means be disengaged from the slot.
Figure 7:
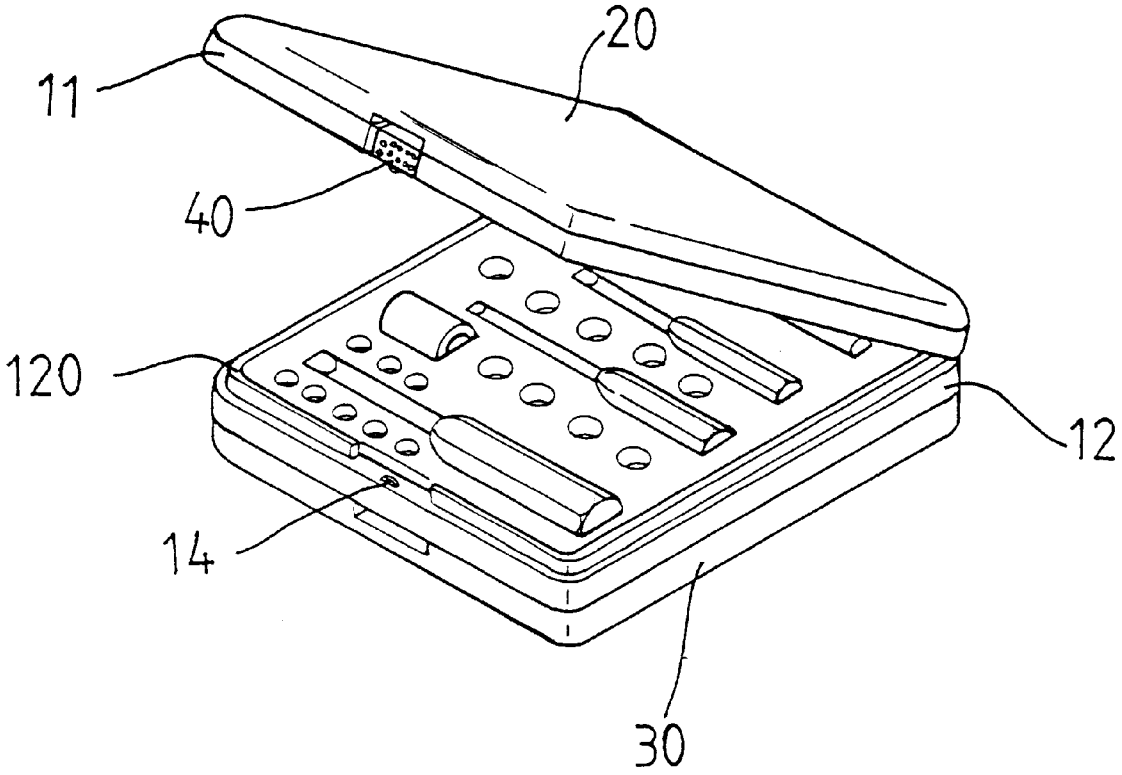
FIG. 7 is a perspective view of the tool box in accordance with the present invention when the cover is opened.

When the hook 45 is engaged with the slot 14, the cover 20 is securely connected to the base member 30, and the end 41 and the flexible plate 43 of the locking means 40 respectively and slightly contact the two end walls 131, 132. Referring to FIG. 6, when shifting the locking means 40 toward the second end wall 132, the flexible plate 43 is deformed and urged against the second end wall 132, and the hook 45 is disengaged from the slot 14 so that the cover 20 can be opened.

When releasing the locking means 40, the flexible plate 43 will push the locking means 40 back to its original position and the hook 45 is engaged with the slot 14 again.

The tools and bits received in the tool box can be seen via the transparent cover 20 and the locking means 40 is connected to be flush with the outside of the cover 20 so that it will not be opened unintentionally.

It is to be understood that the above description and drawings are only used for illustrating some embodiments of the present invention, not intended to limit the scope thereof. Any variation and derivation from the above description and drawings should be included in the scope of the present invention.

What is claimed is:

1. A tool box comprising:

an upper frame having an L-shaped flange extending laterally from the four sides thereof and a first recess defined in said L-shaped flange, a transparent cover securely engaged with said L-shaped flange, a first end wall and a second end wall respectively connected between said flange and said upper frame, said first recess defined between said first end wall and said second end wall, a lower frame pivotally connected to said upper frame and having a base member connected to the bottom thereof, a second recess defined in the top surface of said lower frame, a slot defined in said top surface of said lower frame and located in the bottom defining said second recess, and a locking means movably received in said first recess and having a hook extending from the bottom thereof so as to be movably received in said slot of said lower frame, a flexible plate extending from one of two ends of said locking means and urged against said second end wall when said locking means is shifted toward the second end wall.

2. The locking means as claimed in claim 1, wherein said flexible plate extends from the bottom of the locking means.

3. The locking means as claimed in claim 1 further comprising a first upper stop extending laterally from the top of said first end wall and toward said first recess, a second upper stop extending laterally from the top of said second end wall and toward said first recess, said locking means movably restrained between said first upper stop and said second upper stop.

* * * * *